US008646441B2

(12) United States Patent
Haas et al.

(10) Patent No.: US 8,646,441 B2
(45) Date of Patent: Feb. 11, 2014

(54) FUME BOX FOR A DOMESTIC HEATING APPLIANCE USING SOLID FUEL

(76) Inventors: Frederic Haas, Lutterbach (FR); Fabien Ozil, Rimbach pres Masevaux (FR); Gwennaelle Trouve, Brunstatt (FR); Valerie Tschamber, Hambourg (FR)

( * ) Notice: Subject to any disclaimer, the term of this patent is extended or adjusted under 35 U.S.C. 154(b) by 143 days.

(21) Appl. No.: 12/998,941

(22) PCT Filed: Dec. 17, 2009

(86) PCT No.: PCT/FR2009/001431

§ 371 (c)(1),
(2), (4) Date: Jun. 17, 2011

(87) PCT Pub. No.: WO2010/076417

PCT Pub. Date: Jul. 8, 2010

(65) Prior Publication Data

US 2011/0247533 A1 Oct. 13, 2011

(30) Foreign Application Priority Data

Dec. 17, 2008 (FR) ..... 08 07094

(51) Int. Cl.
*F23J 15/02* (2006.01)

(52) U.S. Cl.
USPC ..... 126/77; 126/73; 126/83; 126/58; 126/60; 110/293; 110/211

(58) Field of Classification Search
USPC ..... 126/77, 83, 73, 193; 110/117, 293
See application file for complete search history.

(56) References Cited

U.S. PATENT DOCUMENTS

| | | | | | |
|---|---|---|---|---|---|
| 38,361 | A | * | 4/1863 | Stwewart | 126/77 |
| 3,802,397 | A | * | 4/1974 | Wariner | 122/18.3 |
| 3,964,943 | A | * | 6/1976 | Andersen | 216/16 |
| 4,319,556 | A | * | 3/1982 | Schwartz et al. | 126/77 |
| 4,479,921 | A | * | 10/1984 | Allaire et al. | 422/180 |
| 4,502,462 | A | * | 3/1985 | Lawrence | 126/77 |
| 4,582,044 | A | | 4/1986 | Ferguson et al. | |
| 4,611,572 | A | * | 9/1986 | Martenson | 126/77 |
| 4,844,051 | A | * | 7/1989 | Horkey | 126/58 |
| 4,896,654 | A | * | 1/1990 | Berlaimont | 126/58 |
| 5,320,086 | A | * | 6/1994 | Beal et al. | 126/512 |
| 6,067,979 | A | * | 5/2000 | Jaasma et al. | 126/77 |
| 6,216,687 | B1 | * | 4/2001 | Campbell et al. | 126/512 |
| 7,360,506 | B2 | * | 4/2008 | Shellenberger et al. | 122/13.01 |
| 2005/0279344 | A1 | * | 12/2005 | Cyris | 126/193 |

FOREIGN PATENT DOCUMENTS

| | | |
|---|---|---|
| WO | WO 00/08390 | 2/2000 |

* cited by examiner

*Primary Examiner* — Steven B McAllister
*Assistant Examiner* — Nikhil Mashruwala
(74) *Attorney, Agent, or Firm* — Law Offices of Steven W. Weinrieb

(57) ABSTRACT

The invention relates to a fume box having a separation partition (16) in the upper portion thereof that comprises a removable catalyst block (17) offset relative to the inlet (10) and the outlet (8), and an intake passage that can be blocked by at least one insulating block. Deflectors slow down the gases and fumes and protect the catalyst block against falling soot and particle. The invention is particularly intended for manufacturers of domestic combustion heating appliances, in particular those using wood.

18 Claims, 3 Drawing Sheets

FUME BOX FOR A DOMESTIC HEATING APPLIANCE USING SOLID FUEL

Figure 1:
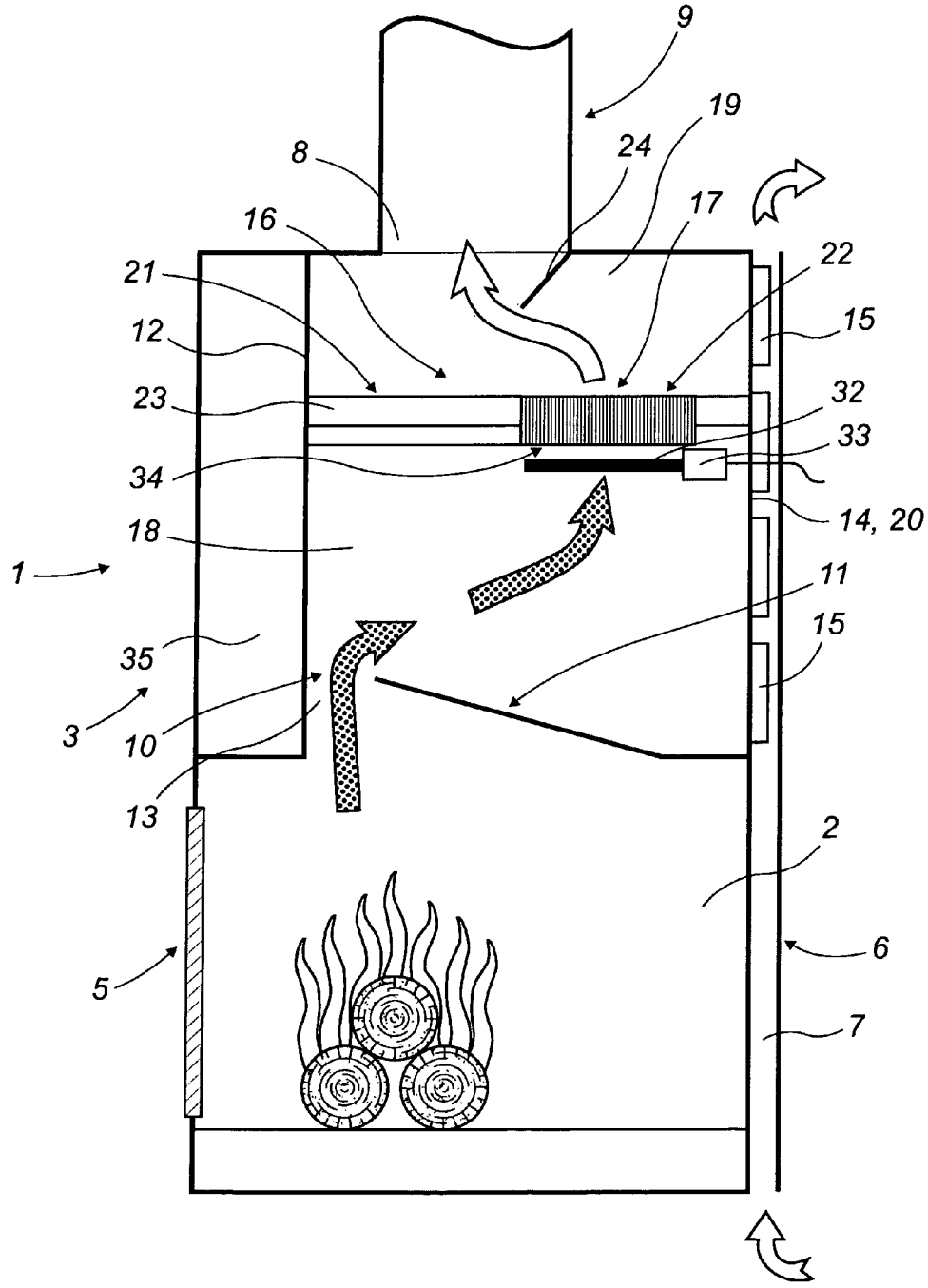

The present invention relates to the field of domestic heating appliances using combustion.

More particularly, it relates to a smoke box having the function of purifying combustion gases and smoke and of heat exchanger for heating appliances using solid fuels, especially wood.

Solid fuels, especially wood, are known to release polluting gases, and particles and microscopic dusts, these different mixtures being present in the smoke.

To provide a solution for reducing these discharges, different means have been imagined, from dust filters with or without electrostatic effect, dust traps whose action is purely mechanical, cyclones with centrifugal effect, to oxidation catalysts, which by virtue of their elevated operating temperature make it possible to calcine these particles and dusts.

Although catalysts contribute an advantageous result within their operating range, they necessitate an elevated temperature in order to operate correctly.

However, during phases of lighting and extinguishing the fire, or else at low firing rate, the temperature necessary for catalysis cannot be attained, and so the catalytic reaction cannot take place correctly.

Furthermore, since the catalyst body is traditionally placed at the outlet of the smoke from the furnace, at the origin of the connecting pipe or beyond, the temperature of the combustion gases and smoke during certain phases and especially the intermediate phases will be insufficient to initiate and maintain the catalysis reaction.

The present invention has as a triple objective, firstly to assure a longer operating duration of the catalyst, at least as long as possible when the fire is burning at reduced firing rate or when it has just been lit or is in the course of being extinguished, secondly to achieve good purification efficiency and finally to make the cleaning and soot-removal operations as fast and easy as possible.

For this purpose, the invention relates to a smoke box that simultaneously assures the functions of purifier and heat exchanger, wherein there is placed a separating wall, which is provided at a position off-centered relative to the inlet and outlet of the smoke box with a catalyst body, whose inner face can be heated, the part toward the front of the separating wall being occupied by a removable plate for access to the upper compartment and to the origin of the connecting pipe to the flue, the smoke box being provided with a lower deflector to slow the smoke and an upper deflector close to the outlet, the body of the smoke box being provided with dissipators in the form of fins, for example, to transmit the heat to the air present between the metal walls of the smoke box and those of the double jacket of the body of the heating appliance.

The foregoing conformations and configurations achieve numerous advantages in addition to the high purification efficiency by calcination of dust, to the oxidation of unburned gases and to the recovery of the additional heat generated by the operation of the catalyst.

Among such advantages there can be cited:

- ease of soot removal and cleaning,
- easy access to the catalyst in order to replace it,
- quasi-continuous operation of the catalyst,
- off-centered nature of the catalyst relative to the outlet of the smoke box,
- presence of deflectors improving the efficiency and cleanliness of the catalyst.

Figure 2:
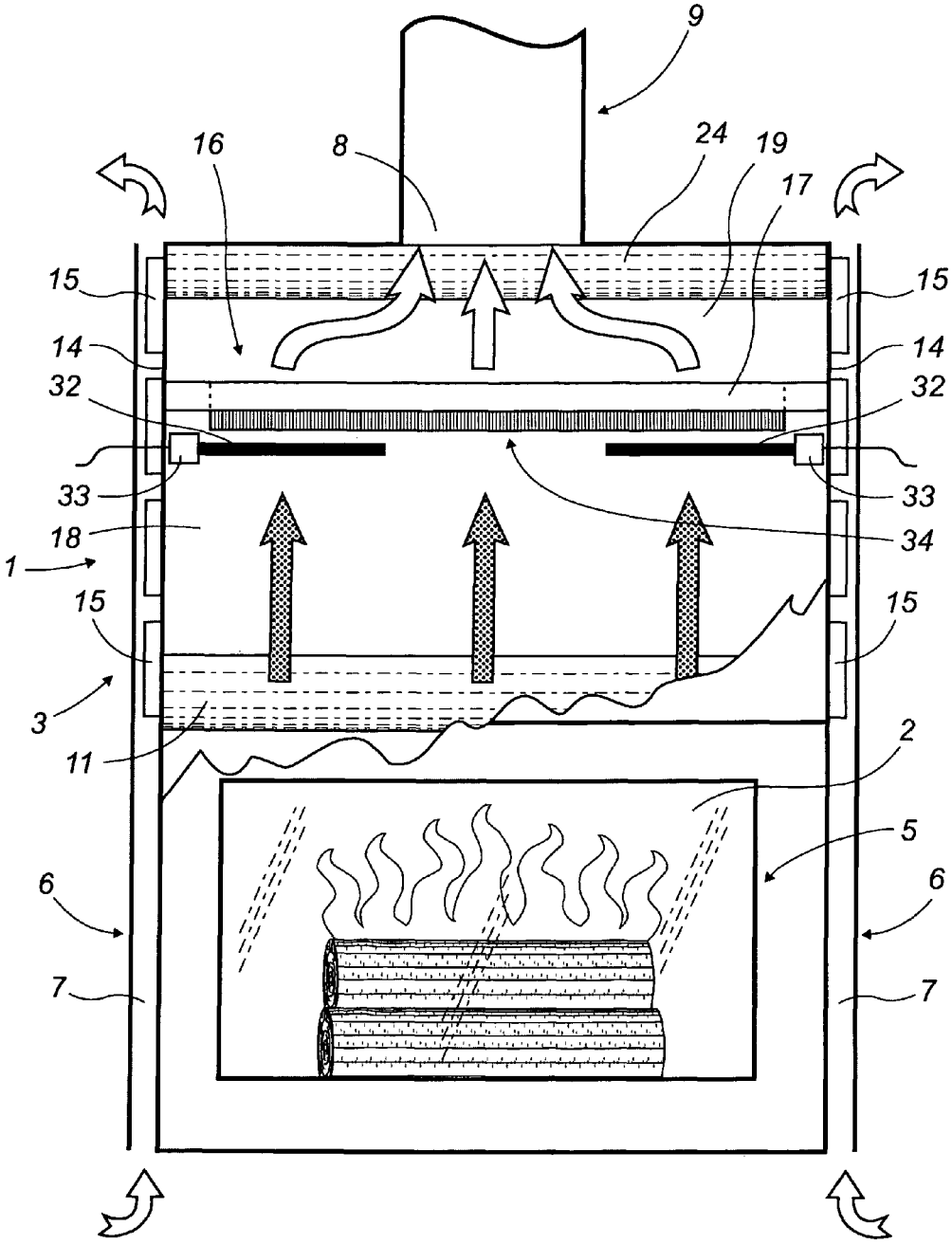
Figure 3:
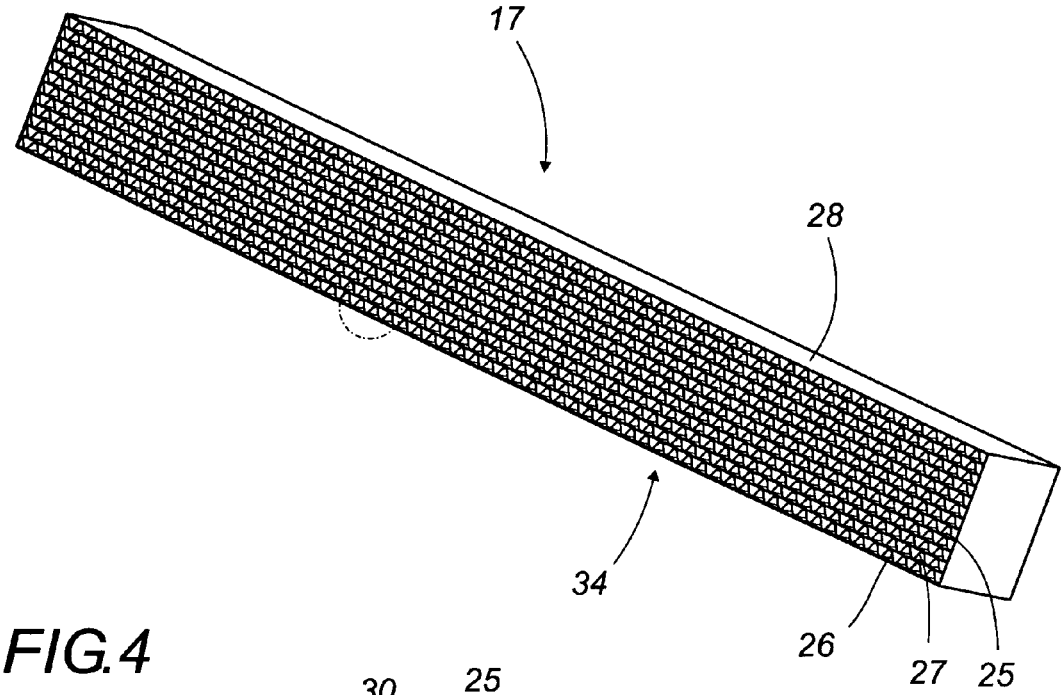
Figure 4:
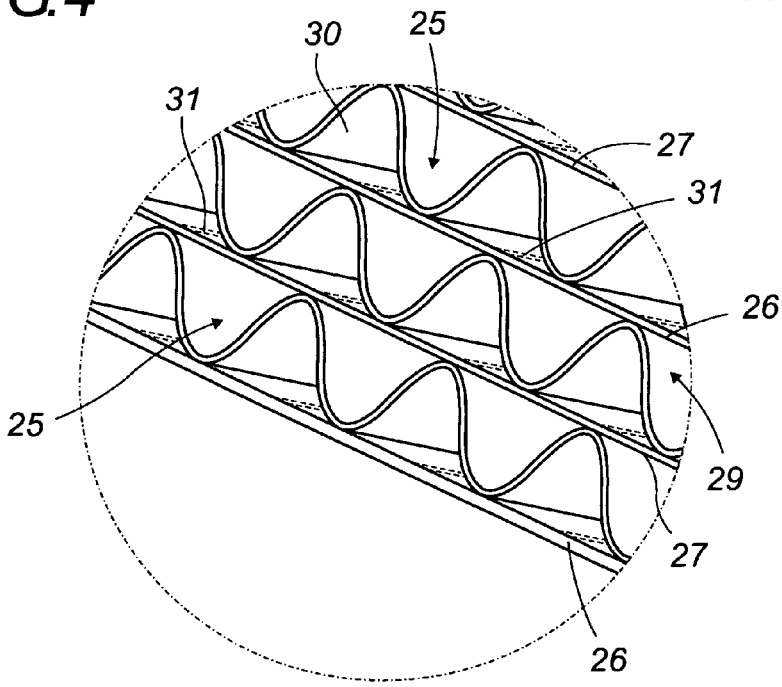

Other characteristics and advantages of the invention will become apparent in the description hereinafter, given by way of example and accompanied by drawings, wherein:

FIG. 1 is a schematic view in cross section of a furnace topped by the smoke box according to the invention, FIG. 2 is a schematic view in longitudinal section, passing through the catalyst block, of a furnace topped by the smoke box according to the invention, FIG. 3 is a perspective view of the catalyst block in its entirety, FIG. 4 is a view on a large scale of the circled part of FIG. 3, showing the internal structure of the catalyst block.

The present invention relates to a smoke box 1 mounted above the furnace 2 of a heating appliance 3, especially but not exclusively using wood 4, and having a glazed front door 5. This heating appliance is preferably but not exclusively provided with an external jacket 6, facing the side walls of the furnace and those of the smoke box, for recovery of heated air. Together with the said side walls, this jacket defines a thin convection volume 7, along which the air, admitted in the lower part, is heated before exiting through orifices in the upper part or being distributed beyond the furnace by ventilation tubes. These orifices and tubes are not shown.

Smoke box 1 discharges upward via an upper outlet 8 in the form of an outlet orifice to an outlet pipe 9 traditionally referred to as connecting pipe for evacuation of combustion gases and smoke.

Smoke box 1 is a quasi-closed volume with lower inlet 10 for passage of combustion gases and smoke originating from the furnace and with upper outlet 8. These combustion gases and smoke exit the smoke box after passing through a catalyst. The latter is composed of two juxtaposed successive compartments, separated by a wall containing the catalyst, through which the combustion gases and smoke pass during continuous heating operation of the wood-burning heating appliance. The smoke box is provided with a lower wall 11, having a slight upward inclination toward its lower inlet 10 over the major part of its width. This lower wall 11 ends short of front side wall 12 of the smoke box, thus leaving a free longitudinal space that forms a longitudinal inlet opening 13 constituting lower inlet 10, via which the combustion gases and smoke exiting the furnace are admitted into the smoke box. This longitudinal inlet opening 13 constituting the passage for entry into the smoke box is situated in the lower part, but at the front of the smoke box, or in other words offset relative to the center of its interior volume, toward the front of the heating appliance.

In the example shown, this longitudinal inlet opening 13 extends along front side wall 12 of the smoke box.

Lower wall 11 of the smoke box serves as the upper wall of the furnace. The upward inclination toward opening 13 of this lower wall 11 and the offset position of longitudinal inlet opening 13 have the objective of slowing the smoke, of lengthening its trajectory, of favoring heat exchange and of protecting the catalyst from the flames of the furnace.

The smoke box has side walls 14, which are provided, for example, with external heat dissipators, for example in the form of fins 15.

As indicated, smoke box 1 is composed of two compartments, a lower compartment, whose lower part is closed by inclined lower wall 11, and an upper compartment, discharging via upper outlet 8 into outlet pipe 9.

The smoke box is divided into two compartments by a separating partition 16, in which there is inserted a catalyst block 17. These compartments are a lower expansion compartment 18 and an upper evacuation compartment 19.

The position of catalyst block 17 is offset toward rear wall 20 of the smoke box, such that it is close thereto, so as to lengthen the trajectory of the combustion gases and smoke, and position catalyst 17 off-center relative to the zone immediately underneath outlet orifice 8.

For this purpose, separating partition 16 has two parts: a front part 21 that can be opened up for access and a rear part 22 receiving the catalyst.

At least rear part 22 is of thick and solid metal construction, for example of cast iron, giving it the benefit of large thermal inertia permitting the body of catalyst 17 to be maintained at its operating temperature for a longer time. It is held in place, for example, by an opening which may or may not be equipped with a frame which receives catalyst block 17 mounted removably in this opening or frame, so that it can be extracted easily to clean and if necessary replace it.

Front part 21 of separating partition 16, preferably of metal, is designed so as to receive, in removable manner, at least one but preferably two thick and thermally insulating blocks such as 23, making it possible by heavy-duty thermal insulation to preserve an elevated temperature in lower compartment 18 of the smoke box, and also so as to permit an access passage to be opened for the purpose of soot removal and maintenance. This removable block or blocks form an access hatch that can be easily opened and closed off for the purpose of cleaning the smoke box. As indicated, the rear part receiving catalyst block 17 is of metal, such as cast iron, forming a heat-accumulator block, permitting supplementary temperature maintenance of catalyst block 17 with a view to prolonging its operating time during heating and thus of obtaining longer durations of purification of the combustion gases and smoke.

In order to slow the smoke even more, and in addition to the offset of the catalyst toward and close to rear wall 20, catalyst block 17 is also off-centered relative to outlet 8 of the smoke box.

The effect is further enhanced by a deflector 24 in the form of an inclined metal sheet projecting from outlet 8 of the smoke box. This deflector 24 is inclined downward and directed toward front wall 12 of the smoke box. It forms a baffle between the upper face of the catalyst block and outlet 8.

As an ancillary function, it deflects the soot and deposits that may fall from outlet pipe 9 during operation of the heating appliance and during soot removal.

The front part of separating partition 16 carries the one or two removable insulating blocks such as 23 that close off the access opening to the upper compartment so as to facilitate the tasks of cleaning and replacement of parts, especially catalyst block 17.

Catalyst block 17 may have different cross-sectional shapes: circular, rectangular, square. Within the scope of the present invention, there is preferred a parallelepiped block such as that shown in FIG. 3. This is a catalyst of metal type with multiple channels 25 formed by the succession of parallel longitudinal walls 26 and 27, the whole being defined by a frame 28.

Parallel metal walls 26 and 27, made of thin metal sheet, are interconnected by a binding structure 29 formed with corrugations, for example of corrugated sheet metal 30, wherein each of the ridge-like crests, such as 31, of the corrugations is integrally joined successively to one then the other parallel wall 26 and 27, thus defining juxtaposed parallel channels 25 with sinusoidal cross-sectional shape and plane bottom. Along the lateral walls of each of these channels 25 there is deposited a catalytic material that generates a catalytic reaction with the gases not burned during combustion in the furnace. True post-combustion takes place there, elevating the temperature of the catalyst body, permitting oxidation of the gaseous residues of incomplete combustion, possibly even to the extent that solid particles and microscopic dusts contained in the smoke are calcined or incinerated.

To lengthen the duration of operation of the catalyst and therefore purification of smoke even more, especially in the intermediate phases of lighting and extinguishing the fire and operating at low firing rate, it is additionally provided to raise the temperature of the space close to the catalyst inlet by one or more electrical resistances such as 32, of the type used as igniters in gas boilers. These are silicon carbide resistors capable of raising the temperature of the space surrounding them quasi immediately to elevated values between 1000° C. and 1500° C.

This or these resistors 32 are carried by a support 33 and placed close to the inlet face 34 of catalyst 17. As many resistors as necessary will be disposed in order to obtain the temperature boost sufficient for initiation or continuation of the catalytic reaction on every occasion, even when the fire is being lit or extinguished or is burning at low firing rate.

This brief but quasi-instantaneous and large temperature elevation permits quasi-immediate startup of the catalyst as soon as the fire is lit, or in other words smoke is being produced.

The smoke box according to the invention may be provided at the front, as in the example shown, with a frontal block or compartment or lintel 35, decorative or heat-accumulating. In the latter case, the operation of the catalyst is improved even more.

The invention claimed is:

1. A smoke box for a domestic heating appliance using solid fuel, comprising:

a front wall, a rear wall, and a pair of side walls;

a furnace defined within a lower portion of said smoke box for burning solid fuel;

a single wall attached to and extending substantially horizontally along a first portion of its length from said rear wall toward said front wall, serving as an upper wall of said furnace, and terminating at a free end portion adjacent to but short of said front wall so as to define a narrow inlet passage between said free end portion of said wall and said front wall, a second portion of said single wall also extending in an upwardly inclined manner so as to effectively serve as a deflector for combustion gases and smoke generated within said furnace whereby said combustion gases and smoke will be directed toward said narrow lower inlet passage;

an upper outlet defined within a substantially central portion of said upper wall of said smoke box;

an outlet pipe fluidically connected to said upper outlet so as to permit the exhaust of said combustion gases and smoke out from said smoke box; and a horizontally disposed separating partition interposed between said narrow inlet passage and said upper outlet, wherein a front portion of said separating partition comprises at least one removable thermal insulating block, while a rear portion of said separating partition comprises a catalytic converter, said catalytic converter being disposed in an offset manner, toward said rear wall of said smoke box, with respect to said narrow inlet passage disposed near said front wall and said upper outlet; wherein a deflector is disposed adjacent to said upper outlet, and is inclined downwardly toward said front wall of said smoke box so as to serve as a baffle for said combustion gases and said smoke emanating from said catalytic converter and flowing toward said upper outlet and said outlet pipe; such that the flow path of the combustion gases and smoke extends in a serpentine manner from said furnace, upwardly through said narrow inlet passage disposed near said front wall, around said free end portion of said wall and back toward said rear wall, upwardly through said catalytic converter, around the deflector and out through said upper outlet and said outlet pipe.

2. The smoke box according to claim 1, wherein:

said catalytic converter is remote from said front wall of said smoke box.

3. The smoke box according to claim 1, wherein:

said catalytic converter is removable.

4. The smoke box according to claim 1, wherein:

said narrow lower inlet passage defines a longitudinal opening that extends along said front wall of said smoke box.

5. The smoke box according to claim 1, wherein:

said deflector is also disposed adjacent to said catalytic converter so as to effectively block said combustion gases and said smoke, emanating from said catalytic converter, from flowing directly into said upper outlet and said outlet pipe, and thereby causing said combustion gases and said smoke to flow around said deflector so as to effectively lengthen the flow path of said combustion gases and said smoke as said combustion gases and smoke flow from said catalytic converter toward said upper outlet and said outlet pipe.

6. The smoke box according to claims 1, wherein:

said catalytic converter is fabricated from metal.

7. The smoke box according to claim 6, wherein:

said metal catalytic converter is fabricated from a plurality of parallel walls and of sheet metal joined together by ridged portions of a corrugated metal sheet comprising a binding structure, so as to form a plurality of parallel channels, on the lateral surfaces of which there is deposited a material serving catalytic converter functions.

8. The smoke box as set forth in claim 1, further comprising:

electrical resistors disposed adjacent to said catalytic converter for elevating the temperature of the space adjacent to said catalytic converter and thus enhance and lengthen the catalytic conversion process.

9. The smoke box asset forth in claim 8, wherein:

said electrical resistors comprise silicon carbide resistors.

10. A smoke box for a domestic heating appliance using solid fuel, comprising:

a front wall, a rear wall, and a pair of side walls;

a furnace defined within a lower portion of said smoke box for burning solid fuel;

a single wall attached to and extending substantially horizontally along a first portion of its length from said rear wall toward said front wall, serving as an upper wall of said furnace, and terminating at a free end portion adjacent to but short of said front wall so as to define a narrow inlet passage between said free end portion of said single wall and said front wall, a second portion of said single wall also extending in an upwardly inclined manner so as to effectively serve as a deflector for combustion gases and smoke generated within said furnace whereby said combustion gases and smoke will be directed toward said narrow lower inlet passage;

an upper outlet defined within an upper wall of said smoke box;

an outlet pipe fluidically connected to said upper outlet so as to permit the exhaust of said combustion gases and smoke out from said smoke box; and a horizontally disposed separating partition interposed between said narrow lower inlet passage and said upper outlet, wherein a front portion of said separating partition comprises at least one removable thermal insulating block, while a rear portion of said separating partition comprises a removable catalytic converter disposed within a framed opening of said separating partition and disposed in an offset manner, toward said rear wall of said smoke box, with respect to said narrow lower inlet passage and said upper outlet; wherein a deflector is disposed adjacent to said upper outlet, and is inclined downwardly toward said front wall of said smoke box so as to serve as a baffle for said combustion gases and said smoke emanating from said catalytic converter and flowing toward said upper outlet and said outlet pipe; such that the flow path of the combustion gases and smoke extends in a serpentine manner from said furnace, upwardly through said narrow lower inlet passage, around said free end portion of said single wall and back toward said rear wall, upwardly through said catalytic converter, around the deflector and out through said upper outlet and said outlet pipe.

11. The smoke box according to claim 10, wherein:

said catalytic converter is remote from said front wall of said smoke box.

12. The smoke box according to claim 10, wherein:

said catalytic converter is removable.

13. The smoke box according to claim 10, wherein:

said narrow lower inlet passage defines a longitudinal opening that extends along said front wall of said smoke box.

14. The smoke box according to claim 10, wherein:

said deflector is also disposed adjacent to said catalytic converter so as to effectively block said combustion gases and said smoke, emanating from said catalytic converter, from flowing directly into said upper outlet and said outlet pipe, and thereby causing said combustion gases and said smoke to flow around said deflector so as to effectively lengthen the flow path of said combustion gases and said smoke as said combustion gases and smoke flow from said catalytic converter toward said upper outlet and said outlet pipe.

15. The smoke box according to claims 10, wherein:

said catalytic converter is fabricated from metal.

16. The smoke box according to claim 15, wherein:

said metal catalytic converter is fabricated from a plurality of parallel walls and of sheet metal joined together by ridged portions of a corrugated metal sheet comprising a binding structure, so as to form a plurality of parallel channels, on the lateral surfaces of which there is deposited a material serving catalytic converter functions.

17. The smoke box as set forth in claim 10, further comprising:

electrical resistors disposed adjacent to said catalytic converter for elevating the temperature of the space adjacent to said catalytic converter and thus enhance and lengthen the catalytic conversion process.

18. The smoke box asset forth in claim 17, wherein:

said electrical resistors comprise silicon carbide resistors.

* * * * *